US005148939A

United States Patent [19]

Roser

[11] Patent Number: 5,148,939

[45] Date of Patent: * Sep. 22, 1992

[54] CONTAINER FOR STORING AND TRANSPORTING A LIQUID

[75] Inventor: Georges Roser, Wingen/Moder, France

[73] Assignee: Soltralentz S.A., Drulingen, France

[ * ] Notice: The portion of the term of this patent subsequent to Jun. 18, 2008 has been disclaimed.

[21] Appl. No.: 639,562

[22] Filed: Jan. 10, 1991

Related U.S. Application Data

[62] Division of Ser. No. 479,709, Feb. 14, 1990, Pat. No. 5,024,346.

[30] Foreign Application Priority Data

Feb. 25, 1989 [DE] Fed. Rep. of Germany ..... 3905976

[51] Int. Cl.[5] ..... B65D 33/56; B65D 88/62

[52] U.S. Cl. ..... 220/401; 220/403; 220/491; 222/105

[58] Field of Search ..... 222/105, 185, 131, 183; 220/401, 403, 408, 410, 491, 494, 485

[56] References Cited

U.S. PATENT DOCUMENTS 3,638,834 2/1972 Goodrich et al. ..... 222/105
3,964,636 6/1976 Rehrig ..... 220/306
5,024,346 6/1991 Roser ..... 220/401

FOREIGN PATENT DOCUMENTS 197809 9/1978 Canada ..... 220/403
2436082 5/1980 France ..... 220/403

*Primary Examiner*—Stephen Marcus
*Assistant Examiner*—S. Castellano
*Attorney, Agent, or Firm*—Herbert Dubno; Andrew M. Wilford

[57] ABSTRACT

A storage and transport container for a fluent material has a stiff outer vessel having an upright side wall formed of a grid of steel bars and a floor. The floor is inclined with respect to the horizontal downward to a predetermined low point at the side wall. An elastically flexible liner in the vessel has a side and a base respectively generally corresponding to the side wall and floor of the vessel and is provided at the low point with a drain fitting. The base is inclined when the liner is only partially filled with the fluent material to the horizontal to the low point at an angle substantially greater than that between the vessel floor and the horizontal but forms the same angle and lying on the floor when fully filled with the fluent material.

3 Claims, 3 Drawing Sheets

CONTAINER FOR STORING AND TRANSPORTING A LIQUID

This is a divisional of co-pending application Ser. No. 07/479,709 filed on Feb. 14, 1990, now U.S. Pat. No. 5,024,346.

FIELD OF THE INVENTION

The present invention relates to a storage and transport container. More particularly this invention concerns such a container for storing and transporting a highly fluent material, normally a liquid.

BACKGROUND OF THE INVENTION

A standard storage and/or transport container for fluent material is known comprising an erect and annular side wall and a bottom wall joined together at the outer edge of the bottom wall and lower edge of the side wall to form an upwardly open vessel, and a flexible bag or bladder within this vessel that lies against its inner surface and that itself contains the material being transported or stored. The side and bottom walls are typically made of round-section metal bars or rods that are spot-welded together in a criss-crossed gridwork with the bars welded at the intersections. It is also possible to use profiled bars and is in fact standard to provide a profiled rim element around the upper edge of the side wall. Frequently extra bars are integrated into the bottom or side wall for increased localized stiffness. In addition the floor of the container is often formed as a pallet that can be handled by a fork lift, and in fact in this case the floor can be made of wood while the sides are made of criss-crossed bars as described immediately above.

In order to empty such a container of a highly fluent material, for instance a liquid, it is standard to provide the liner with a drain fitting that projects from the rigid outer wall adjacent the floor and that itself incorporates a valve. The material inside the liner will empty out rapidly until the level is very low, that is down to the drain, and thereafter emptying will not only be quite slow, especially for a highly viscous liquid, but in fact some liquid will normally be left in the container. Even when the floor of the container is pitched somewhat toward the drain, the last phases of the emptying are invariably very slow due to the low hydrostatic pressure, and some liquid is often trapped in the container.

OBJECTS OF THE INVENTION

It is therefore an object of the present invention to provide an improved storage/transport container for a highly fluent material.

Another object is the provision of such an improved storage/transport container for a highly fluent material which overcomes the above-given disadvantages, that is which can be emptied completely and rapidly.

SUMMARY OF THE INVENTION

A storage and transport container for a fluent material according to this invention has a stiff outer vessel having an upright side wall formed of a grid of steel bars and a floor. The floor is inclined with respect to the horizontal downward to a predetermined low point at the side wall. An elastically flexible liner in the vessel has a side and a base respectively generally corresponding to the side wall and floor of the vessel and is provided at the low point with a drain fitting. The base is of such an elasticity that it is inclined when the liner is only partially filled with the fluent material to the horizontal to the low point at an angle substantially greater than that between the vessel floor and the horizontal but forms the same angle and lying on the floor when fully filled with the fluent material.

Thus with this system the liner will deform elastically as it empties into a shape such that its base forms a greater angle to the horizontal than the base of the stiff vessel containing it so that it will drain more rapidly than a prior-art system where the angles remain the same. At the same time the container according to this invention will be no taller than a prior-art container of identical capacity that would empty much more slowly.

According to a feature of this invention the floor is rectangular and formed of three panels meeting at a Y-shaped line that has arms terminating at adjacent corners of the floor and a leg constituting or pitched down to the low point which is generally central in the side between the other two corners of the floor. Alternately the floor is formed of two panels meeting at a line inclined downward like a trough toward the low point. It is also possible for the floor to be formed of two panels meeting at a line forming the low point. In all cases the base of the liner has corresponding panels which, as mentioned above, form with the horizontal greater angles when the container is only partially filled than when it is completely filled so those panels sit flatly on the respective panels of the vessel floor.

It is further within the scope of this invention for the floor of the vessel to be generally planar. In this arrangement the liner base is, nonetheless, formed as described above so that as the container empties its base lifts up to increase the angle and assist emptying.

DESCRIPTION OF THE DRAWING

The above and other objects, features, and advantages will become more readily apparent from the following, reference being made to the accompanying drawing in which.

SPECIFIC DESCRIPTION

Figure 1:
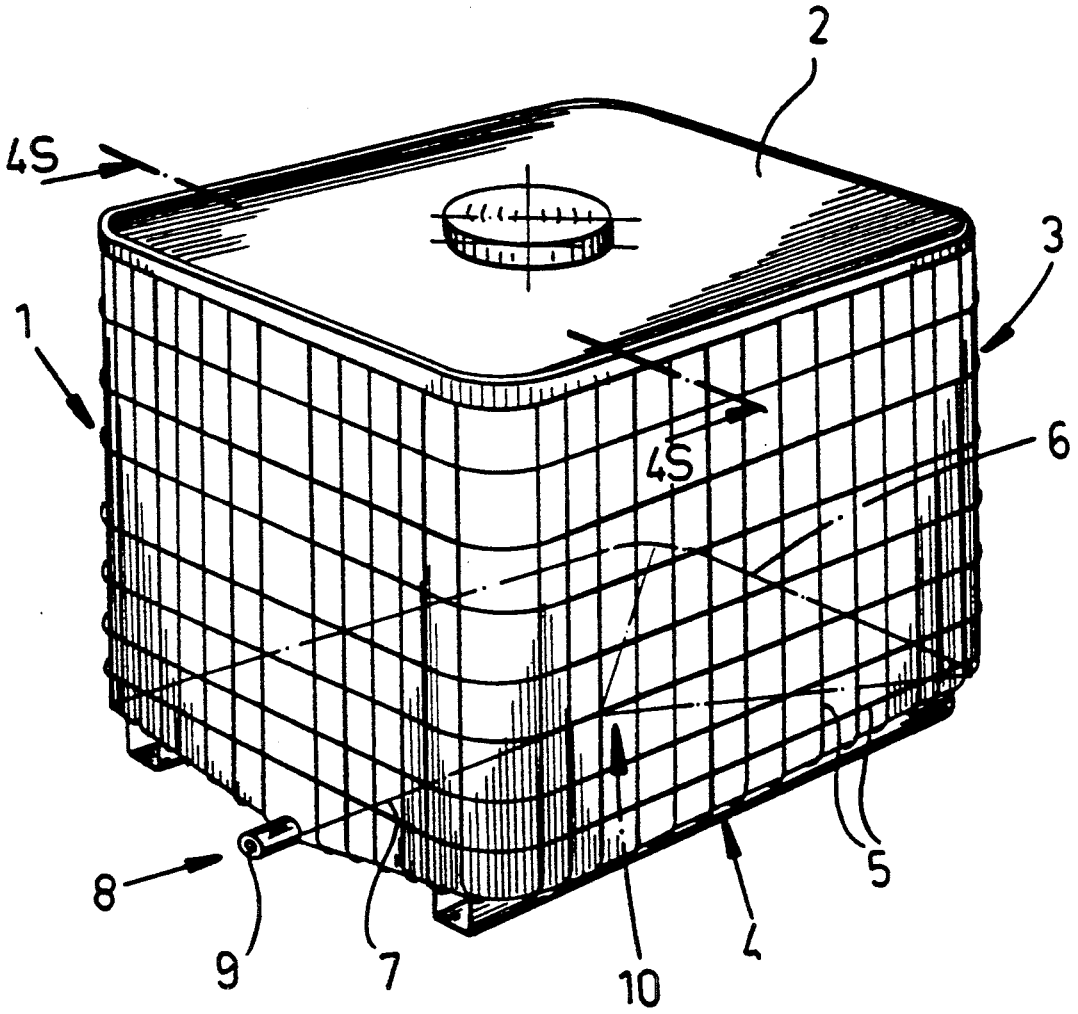
FIG. 1 is a perspective view of a container according to this invention.
Figure 2:
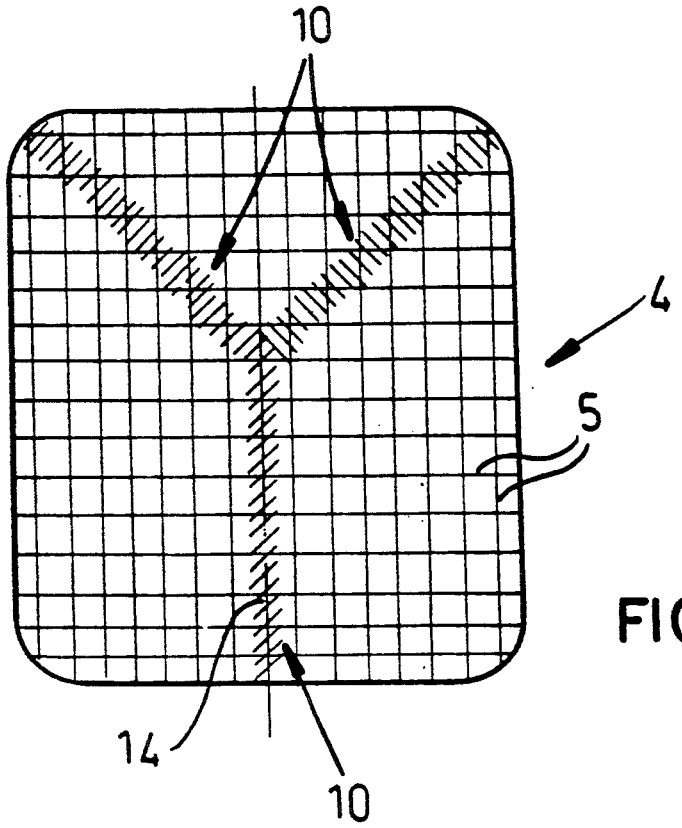
FIG. 2 is a small-scale horizontal section through FIG. 1.

As seen in FIGS. 1 and 2 a transport/storage container according to this invention basically comprises a stiff outer vessel 1 and an elastic liner 2 made of a thermoplastic synthetic resin. The vessel 1 has a side part 3 formed of horizontal and vertical rods 5 that are connected together in a gridwork and welded together at their crossings and a floor 4 that can be similarly constructed or made of wood like a pallet. The liner 2 has a side wall 15 and floor 6 of a shape identical except as described below to that of the vessel 1 and is provided at the juncture between its side wall and floor with an emptying fitting or drain 8 having a valve or plug 9. The bars 5 are bent at the corners to form the floor 4 in the illustrated arrangement.

Figure 3:
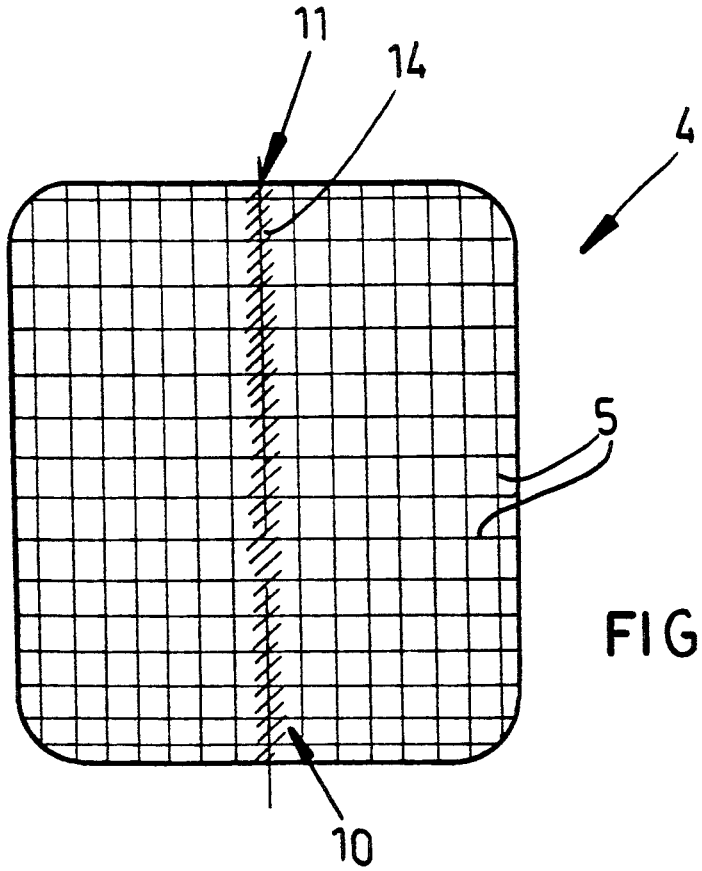
FIG. 3 is a view like FIG. 2 of an alternative arrangement according to this invention.
Figure 4:
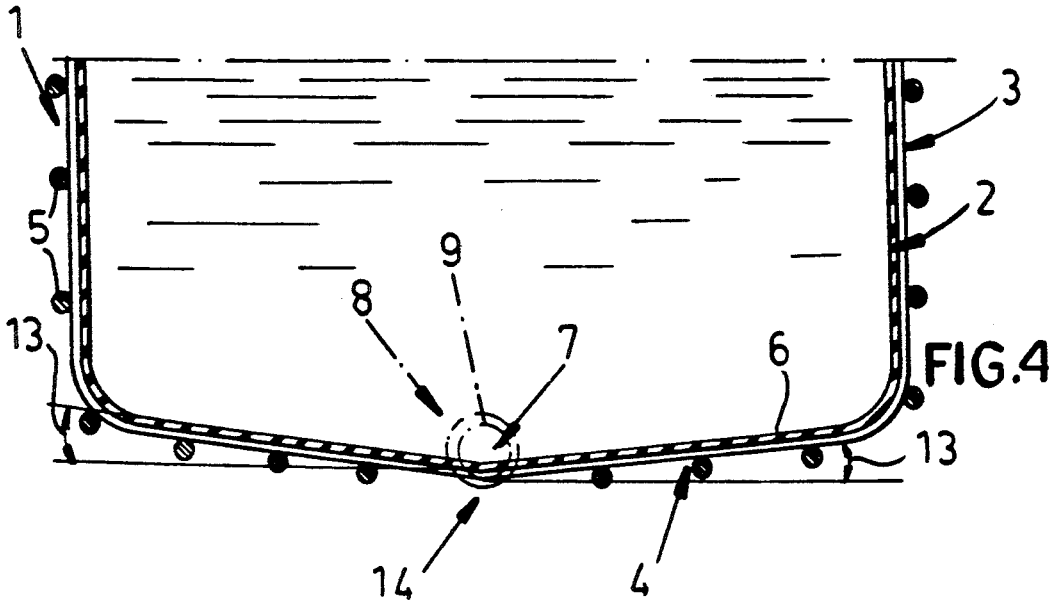
FIGS. 4 and 5 are vertical sections taken along lines 45—45 through the container according to this invention at the start and end of an emptying operation, respectively.
Figure 5:
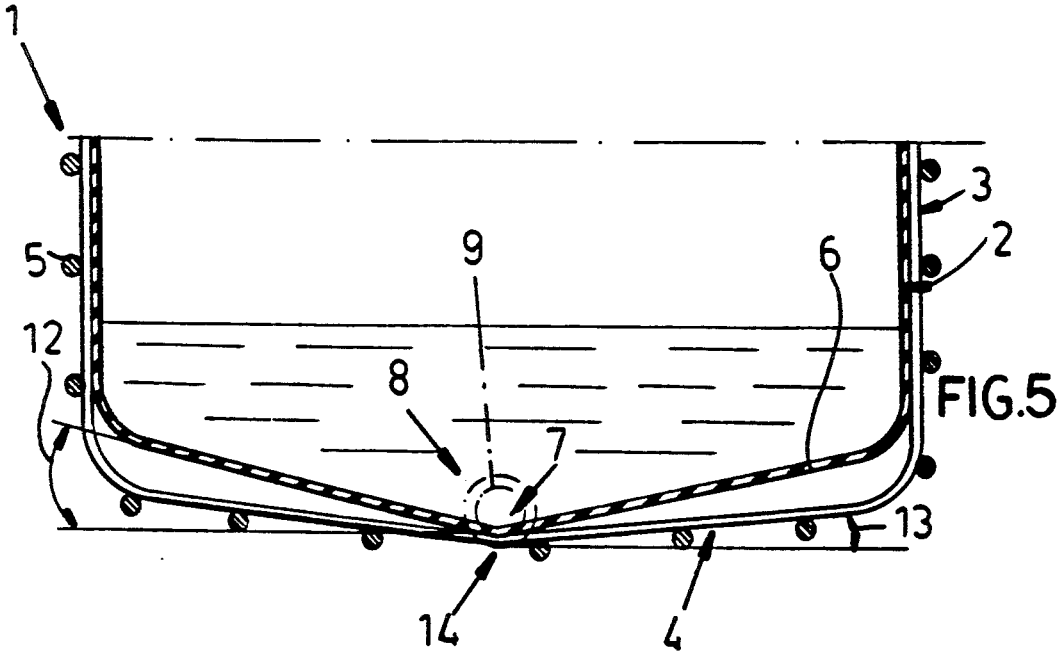
Figure 6:
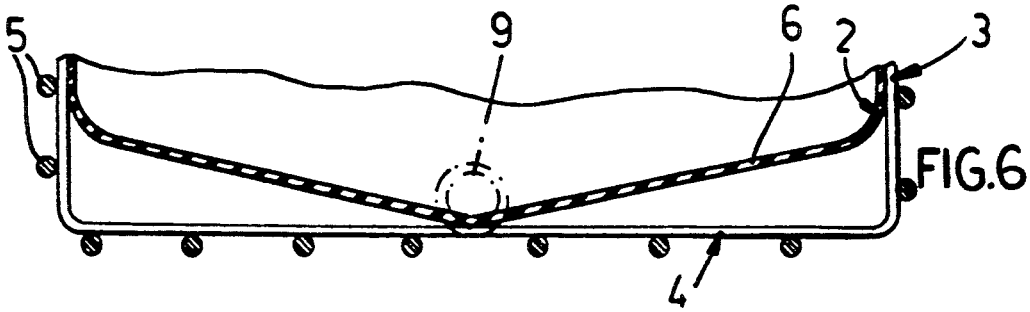
FIG. 6 is a vertical section through another arrangement according to this invention when empty.

According to this invention as shown in FIGS. 2, 4, and 5, the floor 4 of the vessel 1 has a lowermost point 10 defined by a Y-shaped trough 14 whose arms terminate at adjacent corners of the floor 4 and whose leg ends in the middle of the side between the two other corners. It is also possible as shown in FIG. 3 for the floor 4 to have a single central trough 11. Finally as shown in FIG. 6, it is even possible for the vessel 1 to have a planar floor.

In any case when the liner 2 is filled with a liquid as shown in FIG. 4 the floor 6 of the liner 2 corresponds exactly to the shape of the floor 4 of the vessel 1 as the weight of the liquid deforms the liner 2 to this shape. When, however, the liner 2 is only partially full as shown in FIG. 5 or 6 the natural elasticity of the liner 2 deforms it so that its floor 6 raises up to both sides of the low point 10, forming with the horizontal an angle 12 of about 14° which is much more than the angle 13 of about 6° that the rigid floor 4 forms with the horizontal or the angle of 0° of FIG. 6.

As a result of this inherent elastic deformation the liner 2 will drain much more rapidly than it would if it remained of the same shape as the vessel floor 4. Nonetheless when the container 1, 2 is filled it will be no higher than a standard prior-art container of the same capacity.

I claim:

1. A storage and transport container for a fluent material, the container comprising:

a stiff outer vessel having an upright side wall formed of a grid of steel bars and a generally planar floor; and an elastically flexible liner in the vessel having a side and a base respectively generally corresponding to the side wall and floor of the vessel and provided at a low point with a drain fitting, the base being inclined when the liner is only partially filled with the fluent material to the horizontal to the low point at an angle substantially greater than that between the vessel floor and the horizontal but forming the same angle and lying flatly on the floor when fully filled with the fluent material, the base engaging the floor generally only at the low point when the liner is only partially filled with the fluent material.

2. A storage and transport container for a fluent material, the container comprising:

a stiff outer vessel having an upright side wall formed of a grid of steel bars and floor, the floor being formed of two panels meeting at a line forming a low point at the side wall; and an elastically deformable liner in the vessel having a side and base respectively of shapes generally corresponding to the side wall and floor of the vessel and provided at the low point with a drain fitting, the base being elastically deformed to lie flatly on the floor of the vessel when the liner is completely filled with the fluent material, the base being inclined when the liner is only partially filled with the fluent material to the horizontal to the low point at an angle substantially greater than that between the vessel floor and the horizontal due to the inherent elasticity of the liner, the base engaging the floor generally only at the low point when the liner is only partially filled with the fluent material.

3. A storage and transport container for a fluent material, the container comprising:

a stiff outer vessel having a upright side wall formed of a grid of steel bars and a floor, the floor being formed of two panels meeting at a line inclined with respect to the horizontal downward toward a low point at the side wall; and an elastically deformable liner in the vessel having a side and a base respectively of shapes generally corresponding to the side wall and floor of the vessel and provided at the low point with a drain fitting, the base being elastically deformed to lie flatly on the floor vessel when the liner is completely filled with the fluent material, the base being inclined when the liner is only partially filled with the fluent material to the horizontal to the low point at an angle substantially greater than that between the vessel floor and the horizontal due to the inherent elasticity of the liner, the base engaging the floor generally only at the low point when the liner is only partially filled with the fluent material.

* * * * *